US006134186A

United States Patent [19]

Jang

[11] Patent Number: 6,134,186

[45] Date of Patent: Oct. 17, 2000

[54] MULTI-AREA CLOCK OR WATCH

[76] Inventor: Huei-Lung Jang, P.O. Box 90, Tainan City, Taiwan

[21] Appl. No.: 09/437,748

[22] Filed: Nov. 10, 1999

[51] Int. Cl.[7] ..... G04B 19/22

[52] U.S. Cl. ..... 368/27

[58] Field of Search ..... 368/21, 22, 27

[56] References Cited

U.S. PATENT DOCUMENTS

| | | | |
|---|---|---|---|
| 3,271,945 | 9/1966 | Anderson | 368/22 |
| 3,318,085 | 5/1967 | Lee | 368/27 |
| 3,633,354 | 1/1972 | Stemmlen | 348/27 |
| 4,579,460 | 4/1982 | Shannon | 368/27 |

*Primary Examiner*—Vit Miska

[57] ABSTRACT

A multi-area clock or watch includes a base disc, a position ring and an annular hour area section combined together. The hour area section is marked with time differences between countries, the names of countries, and indicating signs. Then the hour area section is rotated relative to an hour indicator on the base disc. Then Adjusting an hour needle align to a country according to the present time, and a user can find out the present time of the foreign country needed to know on the hour area section. So this multi-area clock or watch is handy for carrying out abroad on tour or business.

1 Claim, 7 Drawing Sheets

MULTI-AREA CLOCK OR WATCH

BACKGROUND OF THE INVENTION

This invention relates to a multi-area clock or watch, particularly to one possible to know the time of a foreign country by adjusting the position of the time needle align to one's own country on a hour sector disc very practical and convenient.

Conventional clocks or watches generally indicates only the time of a local country, and hotels or airports may have different clocks to indicate the time of different cities in the world, for travellers to know the present time of the other place they are going. But many clocks indicating different time of many cities occupy a large dimensions, let alone carrying out. So a multi-area clock is disclosed, as shown in FIGS. 1 and 2, in a Taiwan patent application of serial No. 325890, which mainly includes a clock body 10, a graduation disc 11, an hour disc 12, a minute needle 13, a second needle 14, and a cap 15 as main components combined together.

The graduation disc 11 has an inner annular portion 110 divided into 24 equal blocks, and an outer annular portion 111 is divided into 60 equal blocks.

The hour disc 12 is drawn with a world map 120 and with hour lines 121 radially. An hour shaft of the clock rotates according to the rotation of the earth synchronously, with the hour lines 121 aligned to the 24 blocks of the inner annular portion 110. The minute needle 13 and the second needle 14 point the 60 blocks of the outer annular portion 111. Then the time of all the cities in the world can be known from the multi-area clock. But a user must have the geographical locations of all different countries and cities, or it would be very hard to find out the country or the city he wants to know the time. In addition, the hour disc have many dividing lines and blocks not easy to make clear of the present time, and besides, it is different from common 12 graduations, hard to be accustomed to its indication.

SUMMARY OF THE INVENTION

This invention has been devised to offer a multi-area clock or watch possible to be carried out in a journey abroad on tour or business, easy to know the time of one's own country and any foreign city he is staying.

The feature of the invention is a base disc having an inner hour graduation sector and an annular insert groove formed outside around the hour graduation sector for an annular hour sector disc to fit therein and to rotate for adjusting time for finding out the time of foreign countries by marking time differences between one's own country and foreign countries, the names of many foreign counties an indicators on the annular hour sector disc.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
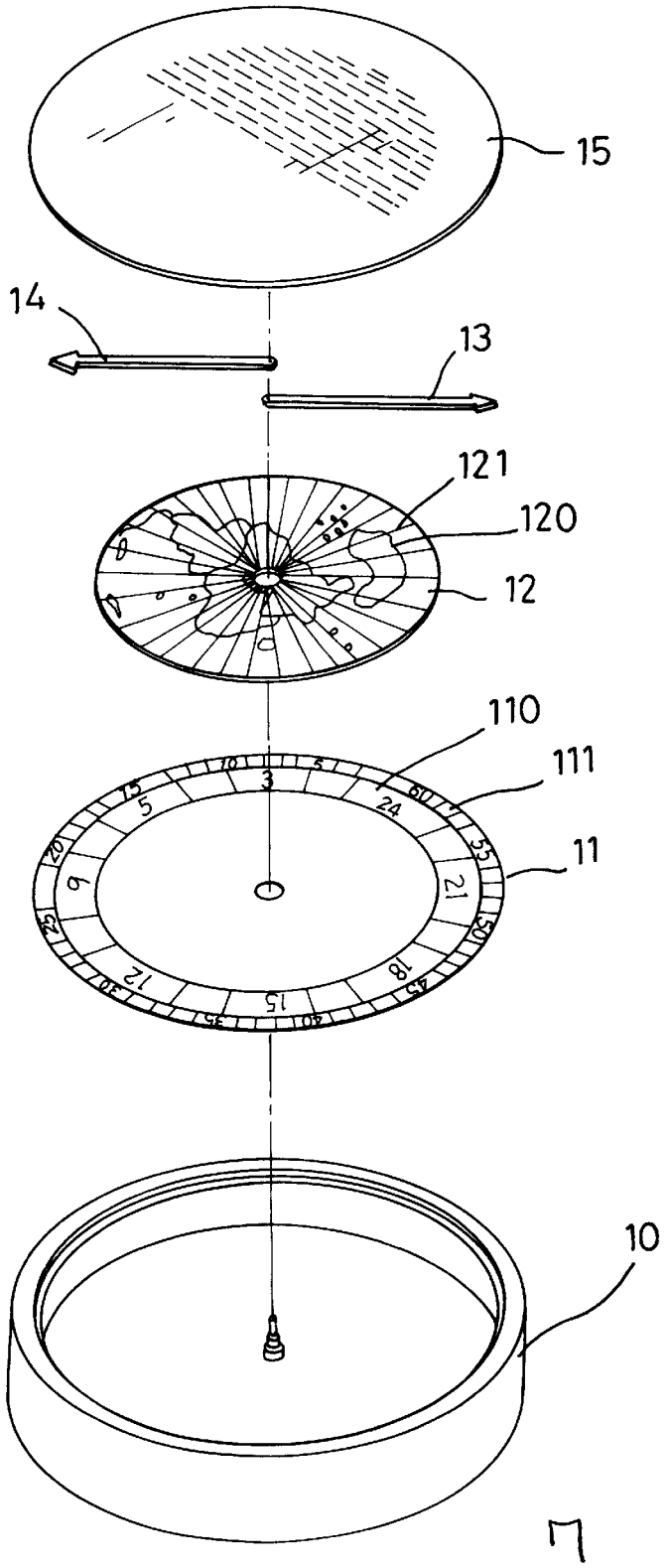
FIG. 1 (PRIOR ART)
FIG. 1 is an exploded perspective view of a known conventional multi-area clock.
Figure 2:
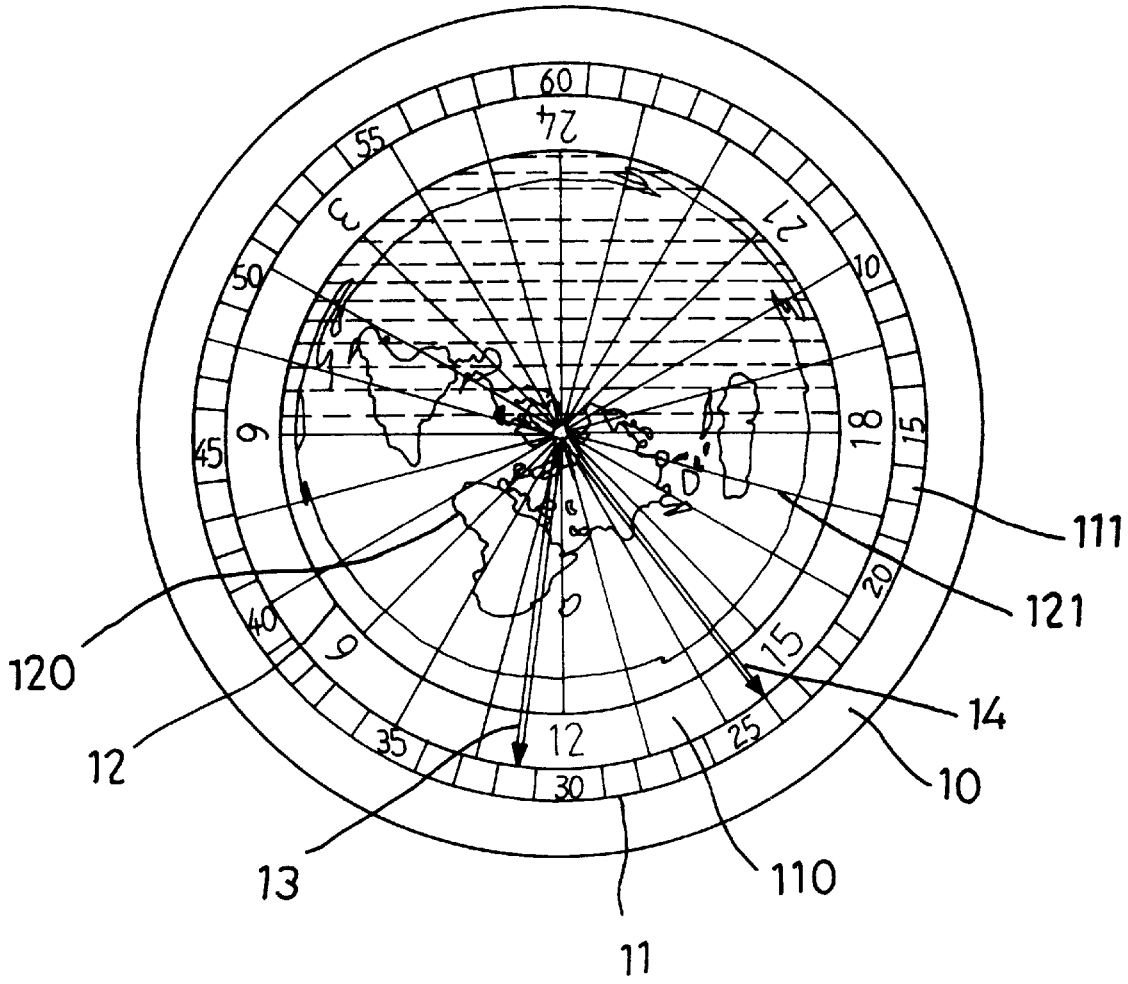
FIG. 2 (PRIOR ART)
FIG. 2 is a an upper view of the known conventional multi-area clock in the present invention.
Figure 3:
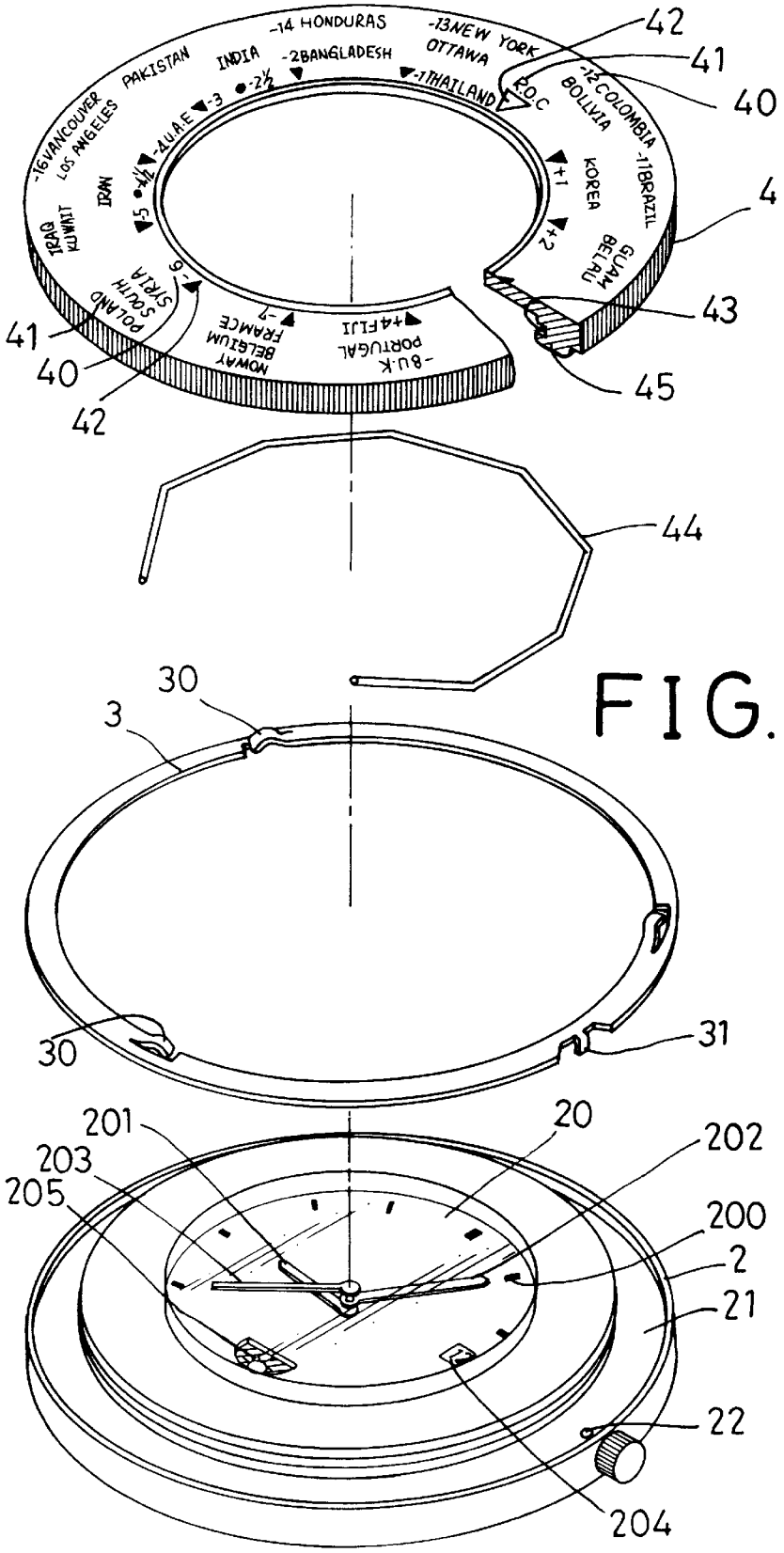
FIG. 3 is an exploded perspective view of a multi-area clock or watch in the present invention.
Figure 4:
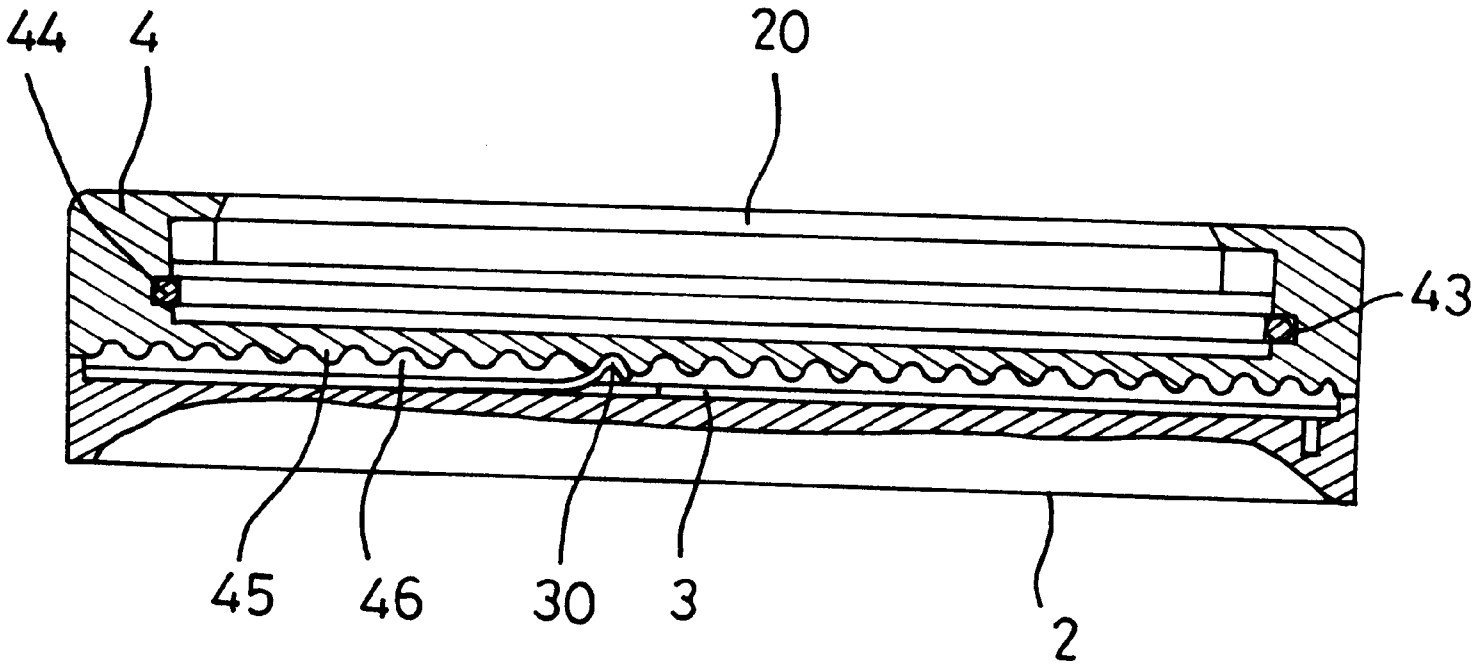
FIG. 4 is a cross-sectional view of teeth 45, grooves 46 and a position ring engaging with one another in the multi-area clock or watch in the present invention.

A preferred embodiment of the multi-area clock or watch in the present invention, as shown in FIGS. 3 and 4, includes a base disc 2, a position ring 3, and an annular hour sector disc 4 as main components combined together.

The base disc 2 has an inner hour indicator 20 provided with hour graduations 200, a hour needle 201, a minute needle 202, a second needle 203, a date indicator 204 and a day and night indicator 205. An annular insert groove 21 is formed outside around the inner hour indicator 20, having a recess 22 formed in the bottom. Further, the position ring 3 is fitted in the annular insert groove 21, having a plurality (three shown in FIG. 3) of swelled keys 30 spaced apart equidistantly, and a downward tab 31 at an outer edge to insert in the recess 22 of the annular insert groove 21 to secure the position ring 3 with the base disc 2.

The annular hour sector disc 4 is positioned on the annular insert groove 21, marked with a plurality of time difference values 40, country names 41, and a plurality of black triangle 42 around on an upper surface. Further, the hour sector disc 4 has an annular groove 43 formed in a lower surface, a curved elastic wire 44 fitted in the annular groove 43, a plurality of small teeth 45 spaced around on the lower surface near the annular groove 43, and a shallow groove 46 respectively formed between every two small teeth 45.

Figure 5:
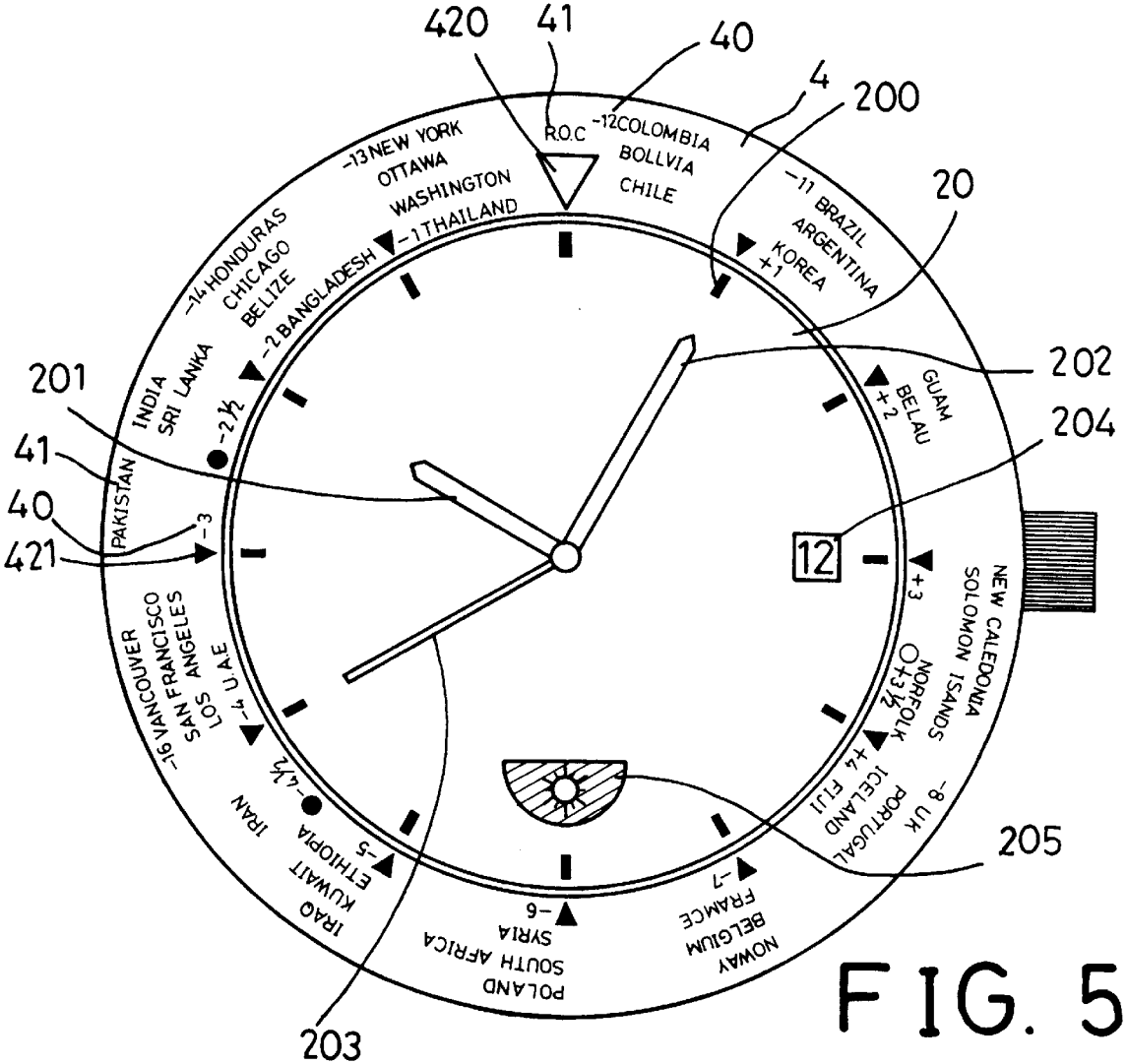
FIG. 5 is an upper view of the multi-area clock or watch in the present invention.

In assembling, referring to FIGS. 3, 4 and 5, the position ring 3 is first inserted in the annular insert groove 21 of the base disc 2, with the tab engaging the fix hole 22. Then the elastic wire 44 is fitted in the annular groove 43 of the annular hour disc 4, and partly protruding out of the groove 43 so that the hour area section 4 is pressed to close on the annular groove 21. And the protruding-out portion of the elastic wire 44 partly clamps the hour graduation sector 20 of the base disc 2, combining the annular hour area section 4 with the base disc 2. Next, the small teeth 45 and the small grooves 46 on the lower surface of the hour area section 4 are made to engage the keys 30 of the position ring 3 with elasticity so that the hour area section 4 may be rotated to let the keys 30 slide over the teeth 45 in adjusting the position of the hour area section 4. After adjusting, each key 30 may engage one of the grooves 46 to keep the hour area section 4 in place temporarily.

Figure 6:
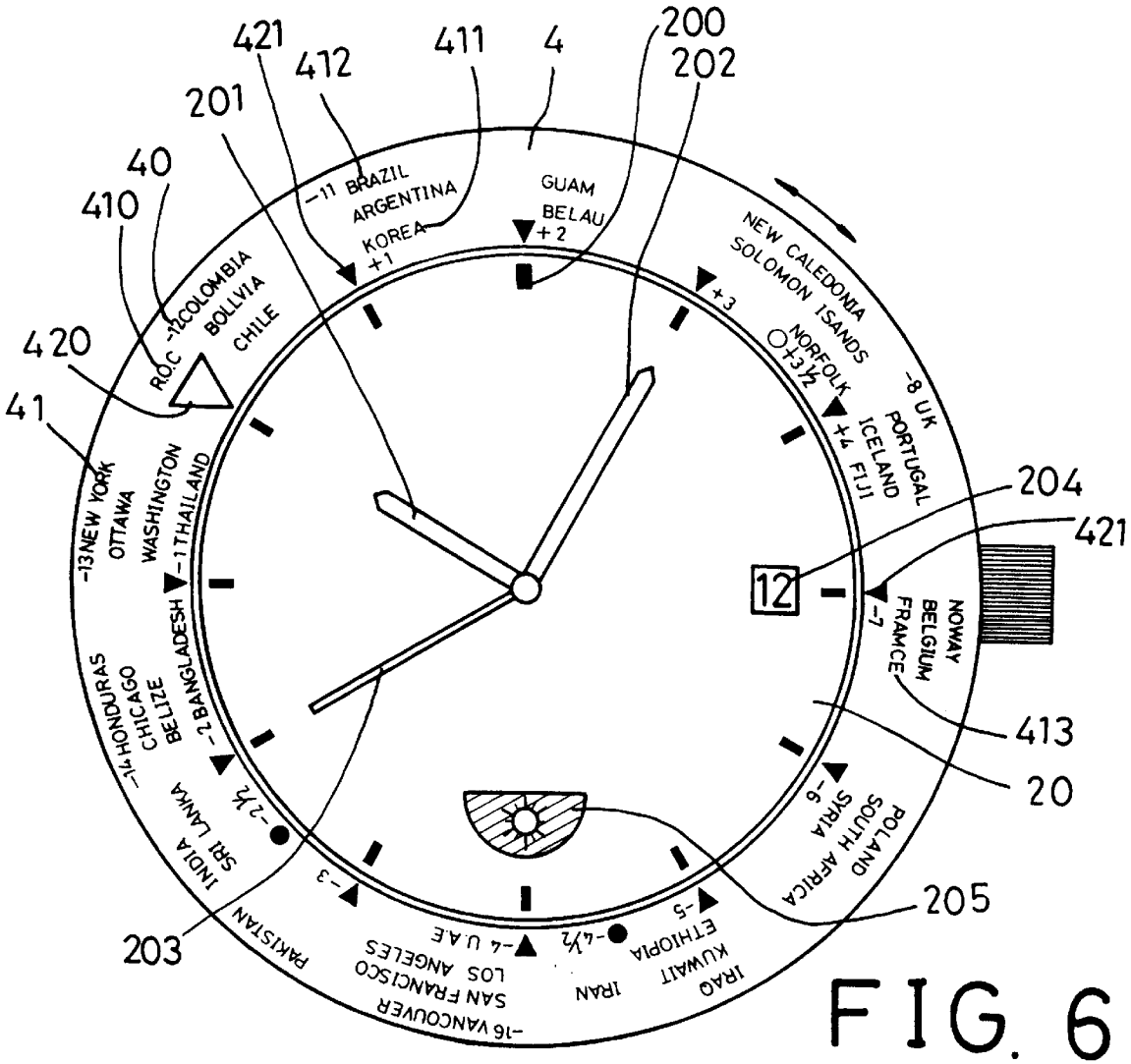
FIG. 6 is an upper view of the multi-area clock, checking the time of foreign countries depending on the time of Taiwan in the present invention; and, FIG. 7 is an upper view of the multi-area clock, checking the time of Taiwan depending on the time of a foreign country in the present invention.

In using, referring to FIGS. 5 and 6, a user only rotates the annular hour area section 4 relative to the position ring 3, permitting the small black triangle 42 of a country 41 align to the hour needle 201 of the hour indicator 20. Then the present time of a foreign country may be found out on the hour area section 4, for example, now the time in Taiwan is 10:05 a.m. on 12th of the month, (as shown in FIG. 6), the hour area section 4 is rotated to let the big hollow triangle 420 marked with R.O.C. align to the hour needle 201. So the small black triangle 421 marked as Korea can be found at the eleven hour on the hour area section 4, with the mark +1 marked under Korea. Thus the time 10:05 a.m. in Taiwan is known to be the time 11:05 in Korea.

Figure 7:
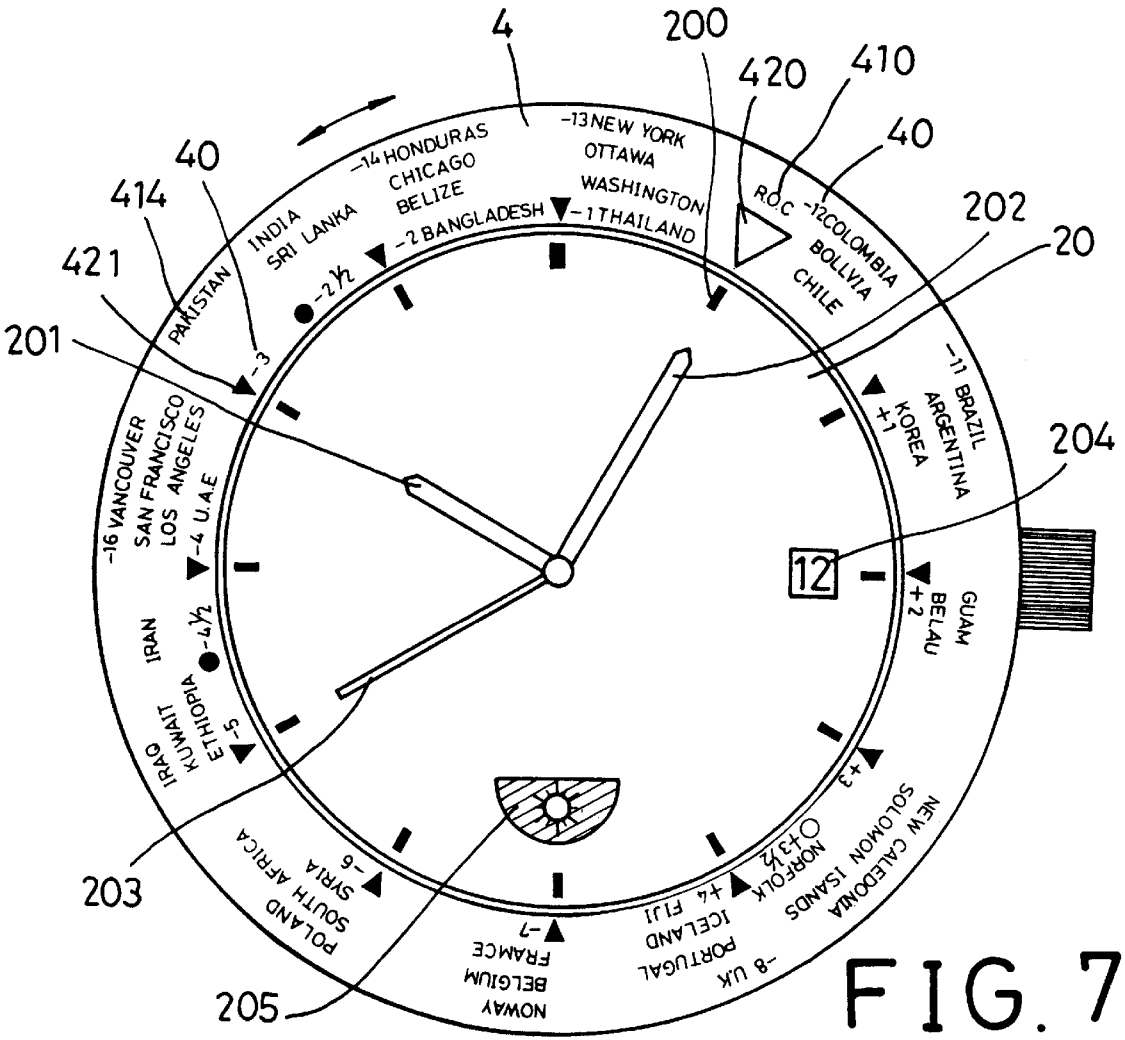

In the same way as described above, the time difference in Brazil 412 is written −11, meaning that the time in Brazil is 11 hours slower than the time in Taiwan, that is, 10:05 a.m. in Taiwan is 11;05 p.m. one day earlier than Taiwan in Brazil. Next, for example, if the time in France is wanted to know, it is found at the three o'clock position on the hour area section 4, with a small black triangle 421 marked with −7 under the names of France, Belgium and Norway. So the time in France is 7 hours slower than Taiwan, being 3:05 a.m. Inferring in the same way, the time at present in any foreign country or city may be found out on the hour area section 4 and the hour indicator 20 so long as the name of a country or a city is written thereon. One more for example, if a person went to Pakistan and wants to know the time in Taiwan, as shown in FIG. 7. the time in Pakistan shows 10:05 a.m., then the time in Taiwan can be found at the big hollow triangle 420 on the hour area section 4, 1:05 p.m. the same day, needing no time to find out, quite simple and convenient. If a person goes on tour to any foreign country, he does not need adjust his watch to correct the time in foreign cities.

The multi-area clock or watch in the invention has the following advantages.

1. Only rotating the annular area section 4 and aligning the hour needle 201 of the hour indicator 20 can find out the time of any foreign country or city, very simple and convenient.

2. The components are simple and only a few, easy to assemble and use.

3. The annular hour area section can be applied to any clock or watch to use.

4. The time difference and the name of the countries or cities can be altered according to different necessity.

While the preferred embodiment of the invention has been described above, it will be recognized and understood that various modifications may be made therein and the appended claims are intended to cover all such modifications which may fall within the spirit and scope of the invention.

What is claimed is:

1. A multi-area clock or watch comprising a base disc, an hour indicator on an inner portion of said base disc and having graduations indicating hours, and an hour needle, a minute needle, a second needle, a date indicator, a day and night indicator, a position ring, and an annular hour area section orderly combined with said base disc;

and characterized by said base disc having an annular insert groove around the outside of said hour indicator, a fit hole bored in a bottom of said annular insert groove, said position ring having a plurality of keys swelled up a little and spaced apart equidistantly and a downward tab to fit in said fit hole of said annular insert groove, said annular hour area section having an annular groove formed in a lower surface thereof and a plurality of small teeth formed annularly on the lower surface thereof near said annular groove, an elastic wire fitting in said annular groove, said small teeth having a shallow groove between every two of them for said keys to engage temporarily to let said annular hour area section rotatable with said keys slide over the small teeth so as to adjust the location of the annular hour area section relative to said hour indicator.

* * * * *